United States Patent [19]

Fujishiro

[11] 4,281,595

[45] Aug. 4, 1981

[54] MULTIPLE-PURPOSE OFFSET ROTARY PRINTING PRESS

[75] Inventor: Yuji Fujishiro, Tokyo, Japan

[73] Assignee: Kabushiki Kaisha Tokyo Kikai Seisakusho, Tokyo, Japan

[21] Appl. No.: 59,222

[22] Filed: Jul. 20, 1979

[30] Foreign Application Priority Data

May 26, 1979 [JP] Japan ..... 54-065410

[51] Int. Cl.[3] ..... B41F 5/06; B41F 7/12; B41F 13/36

[52] U.S. Cl. ..... 101/177; 101/180; 101/181; 101/182; 101/218; 101/221

[58] Field of Search ..... 101/176, 177, 178, 179, 101/180, 181, 182, 220, 221, 222, 223, 224, 225, 137, 138, 139, 140, 143, 247

[56] References Cited

U.S. PATENT DOCUMENTS 3,329,086 7/1967 Pullen ..... 101/177

FOREIGN PATENT DOCUMENTS 2330277 1/1975 Fed. Rep. of Germany ..... 101/181
2409219 9/1975 Fed. Rep. of Germany ..... 101/179
1257552 2/1961 France ..... 101/177
1158470 7/1969 United Kingdom ..... 101/218

*Primary Examiner*—J. Reed Fisher

[57] ABSTRACT

A pair of three cylinders train units and a four cylinder train unit are provided in relationship such that a pair of impression cylinders of the former are adjacent to a pair of blanket cylinders of the latter, respectively.

The blanket cylinders of the latter are switched between a first position in which the blanket cylinders make contact with each other and with their respective plate cylinders and a second position in which the blanket cylinders are isolated from each other, make contact with their respective plate cylinders and with their respective impression cylinders of the three cylinder train units.

The switching between extreme positions can be completed in one motion by an angle increase shifting mechanism using gears which are added to the switching means.

Throw-off means for the blanket cylinders can be diverged independently and branchingly from each extreme position by a pin clutch mechanism which is added to the switching means. In order to prevent any racing of the cylinders each throw-off position is defined within the range of which teeth of gears meshing at the extreme positions are not out of gearing.

4 Claims, 26 Drawing Figures

MULTIPLE-PURPOSE OFFSET ROTARY PRINTING PRESS

BACKGROUND OF THE INVENTION

The present invention relates to a web fed offset rotary printing press and more particularly to a multiple-purpose offset rotary printing press capable of being adapted for printing of a very wide range by the method of switching between two different printing modes in the single printing press, for example, quadruplicate printings on one side of a web, triplicate printings on one side and monochromatic printing on the other side, duplicate printings on both sides of a web, duplicate printing on one side and monochromatic printing on the other side, and monochromatic printing on each of both sides of two webs respectively.

Constructions and operations of well-known offset rotary printing units are divided into the following classes according to the arrangement of cylinders thereof.

(1) A three cylinder train unit in which a blanket cylinder is between a plate cylinder and an impression cylinder and contacts with both of them, to afford a monochromatic printing on one side of a web.

(2) A four cylinder train unit in which a pair of blanket cylinders mutually contacting are between a pair of plate cylinders cooperating therewith and contacting therewith respectively, to afford a monochromatic printing on both sides of a web by feeding the web between the blanket cylinders. This is called a blanket to blanket design.

(3) A five cylinder train unit in which a common impression cylinder is between a pair of the blanket cylinders of the four cylinder train unit, to afford duplicate printings on one side of a web. This is called a satellite design or a common impression cylinder design. In case of adding a third or fourth blanket cylinder in contact with the common impression cylinder, this affords triplicate or quadruplicate printings on one side of a web.

(4) A printing unit capable of switching between the four cylinder train and the five cylinder train, is described in French Pat. No. 1,257,552 and U.S. Pat. No. 3,329,086. This can be used in two ways, whereby one is used as the four cylinder train unit and the other is used as the five cylinder train unit by the method that the pair of the blanket cylinders are switched between a first position i.e. the four cylinder train in which they make contact with each other, with their respective plate cylinders and are isolated from the common impression cylinder and a second position i.e. the five cylinder train in which they are isolated from each other, make contact with their respective plate cylinders and with the common impression cylinder. This unit can afford a monochromatic printing on both sides of a web or duplicate printings on one side of a web.

Now, using the above described printing units, if it is desired to be adapted for multiple-purpose printing including quadruplicate printings on one side of a web, triplicate printings on one side and monochromatic printing on the other side, duplicate printing on both sides, duplicate printing on one side and monochromatic printing on the other side, and monochromatic printing on both sides of two webs respectively, it is required to have either twelve cylinders consisting of four juxtaposed arrangements of the three cylinder train units as described in the item (1) or ten cylinders consisting of two juxtaposed arrangements of the switching between four and five cylinder train units as described in the item (4).

However, the former requires a greater quantity of cylinders whereby a large space is occupied so that it would be expensive. On the other hand, as the latter requires a pair of mechanisms for switching between the position where the pair of the blanket cylinders mutually contact and the position where the blanket cylinders are separated from each other and contact with the common impression cylinder, it is easy to make a mistake, while the operation for switching and construction thereof is complicated and expensive.

Further, as the latter has the single and common impression cylinder which separates from and contacts with the pair of the blanket cylinders, not only it can not help making short the length between the two extreme positions in which the pair of the blanket cylinders are bodily moved, but also it requires a rotative movement of one of the pair of the blanket cylinders in reverse direction when they are switched from one to the other position.

Therefore, it is impossible to achieve the complete separation of engagement of gears from each other by the limitation of the movement only in the direction along the faces of the gears, so that the well-known device has been designed so as to be more movable in the direction along the axes of the gears. Further particulars in connection with the above description are indicated in the U.S. Pat. No. 3,329,086 and Japanense patent publication No. 51-14922 corresponding thereto. That is to say, the latter comprises the complicated geared reversing mechanism including more shifting in the direction along the axes of the gears, the pair of the switching mechanisms for each pair of the blanket cylinders having the geared reversing mechanism respectively.

Furthermore, the well-known switching mechanism for the pair of the blanket cylinders has been achieved by a method in which the shifting of the blanket cylinders from one to the other positions is made via the intermediate mode, i.e. the state of the impression throw-off. This inconveniently requires two reciprocating motions of the actuator, as well as a conversion of the fulcrum of the power transmitting link at the intermediate mode. As a result, the conventional system requires a troublesome operation which may incur an error.

SUMMARY OF THE INVENTION

A pair of three cylinder train units and a fort cylinder train unit are provided in relationship such that a pair of impression cylinders of the former are adjacent to a pair of blanket cylinders of the latter, respectively.

The blanket cylinders of the latter are switched between a first position in which the blanket cylinders make contact with each other and with their respective plate cylinders and a second position in which the blanket cylinders are isolated from each other, make contact with their respective plate cylinders and with their respective impression cylinders of the three cylinder train units.

The switching between extreme positions can be completed in one motion by an angle increase shifting mechanism using gears which is added to the switching means.

A throw-off means for the blanket cylinders can be diverged independently and branchingly from each extreme position by a pin clutch mechanism which is added to the switching means. The pin clutch mechanism comprises a member attached to a main shaft of the angle increase mechanism and is divided into three pieces, namely a front piece, a center piece, and a rear piece, the center piece being adapted to be selected and being engaged by and disengaged from the front and rear pieces by the operation of the pin clutch.

OBJECTS OF THE INVENTION

It is, therefore, an object of the present invention to create and provide a multiple-purpose offset rotary printing press capable of being adapted for printing of a very wide range by the method of switching only a pair of the blanket cylinders and using only ten cylinders with resulting low costs, simple construction and a compact space occupied thereby.

It is another object of the present invention to create and provide a multiple-purpose offset rotary printing press in which engagement with and disengagement from gears at the time of switching a pair of the blanket cylinders can be achieved easily, exactly, simply and with low costs by the movement in the direction along faces of the gears without displacement in the direction along axles of the gears.

It is another object of the present invention to create and provide a multiple-purpose offset rotary printing press, in which the large angular displacement of eccentric sleeves, which is required for directly shifting the pair of the blanket cylinders from one to another position, can be effected safely, promptly and easily by a single stroke of an actuator.

It is another object of the present invention to create and provide a multiple-purpose offset rotary printing press, in which the intermediate mode, i.e. the impression throw-off is provided not merely as a relaying position in the switching between a first position and a second position of the blanket cylinders, but, rather, the switching to the intermediate mode within the limits of engagement of gear trains from each extreme position is possible independently and branchingly from either of the first and second positions, after completion of the switching to either position, so that it is possible to reset the cylinders to the cylinder arrangement under use safely, promptly and easily, after the completion of the work which requires a shifting to the impression throw-off.

BRIEF DESCRIPTION OF THE DRAWINGS

FIGS. 3 to 5 show various printing modes able to be achieve by the offset printing press according to this invention in which:

FIGS. 3D, 3E, 3F and 4 are illustrations according to a first printing mode, FIG. 3A shows a state of quadruplicate printings on one side of a web, FIG. 3B shows a state of quadruplicate printings on the other side of a web, FIG. 3C shows a state of duplicate printings on both sides of a web, FIG. 3D shows a state of triplicate printings on one side and monochromatic printing on the other side of a web as shown by a solid line, or a state of triplicate printings on the other side and monochromatic printing on one side of a web as shown by a broken line, FIG. 3E shows a state of triplicate printings on the other side and monochromatic printing on one side of a web, FIG. 3F shows a state of duplicate printings on one side and monochromatic printing on the other side of a web as shown by a solid line, or duplicate printings on the other side and monochromatic printing on one side of a web as shown by a broken line, FIG. 4 shows a state of monochromatic printing on both sides of two webs, whereby printings consisting of 16 pages are achieved at the same time via 8 pages per a web, FIGS. 13A and 14A show the positional relationship of the essential parts of the cylinder shifting mechanism in the state as shown in FIG. 7, while FIGS. 13B and 14B show the same in the state as shown in FIG. 8, and FIGS. 15A and 15B show the positional relationship of essential parts of the shifting mechanism in the state of impression throw off of the printing cylinders, in which FIG. 15A shows the positional relationship of the essential parts taken when the impression throw off of the printing cylinders is started from the printing mode as shown in FIG. 7, i.e. the printing mode as shown in FIGS. 13A and 14A, while FIG. 15B shows the same positional relationship taken when the impression throw off of the printing cylinders is started from the printing mode as shown in FIG. 8, i.e. the printing mode as shown in FIG. 13B and 14B.

DESCRIPTION OF THE PREFERRED EMBODIMENT

Hereinafter, this invention will be more fully described by a specific embodiment with reference to the accompanying drawings.

Figure 1:
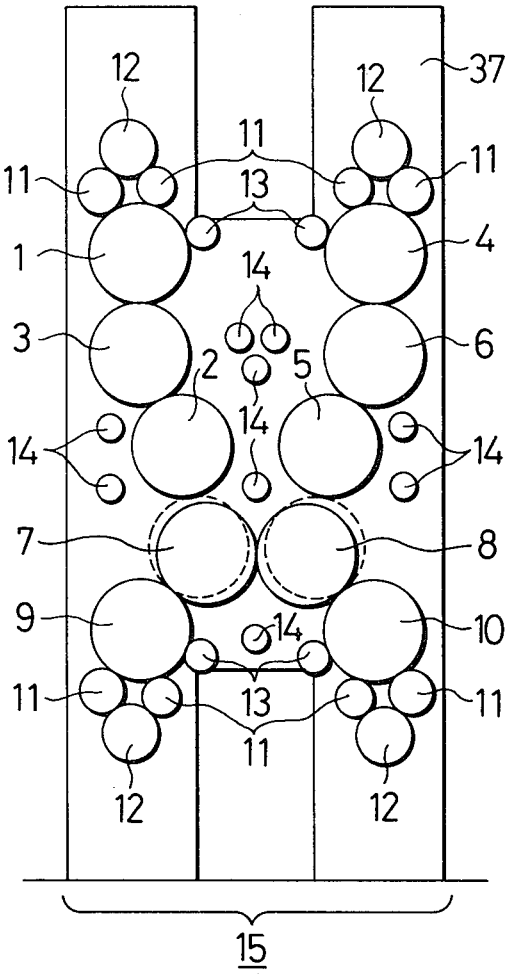
FIG. 1 is an illustration of the positional relationship between all of the cylinders in the offset rotary printing press according to this invention.

As shown in FIG. 1 cylinders of the offset printing press according to this invention are arranged in a systematic combination of a pair of three cylinder train units with a four cylinder train unit. One of the three cylinder train units consists of a plate cylinder 1, an impression cylinder 2 and a blanket cylinder 3. The blanket cylinder 3 is between the both cylinders 1 and 2, and contacts with both of them. The other three cylinder train unit consists of a plate cylinder 4, an impression cylinder 5 and a blanket cylinder 6. The blanket cylinder 6 is between the both cylinders 4 and 5, and contacts with both of them. The pair of three cylinder train units are juxtaposed in symmetrical arrangement. The four cylinder train unit consists of a pair of blanket cylinders 7 and 8, a pair of plate cylinders 9 and 10 cooperating therewith respectively. The pair of the blanket cylinders 7 and 8 contact with each other at the position where they are respectively adjacent to both of the impression cylinders 2 and 5 of the three cylinder train units.

Figure 6:
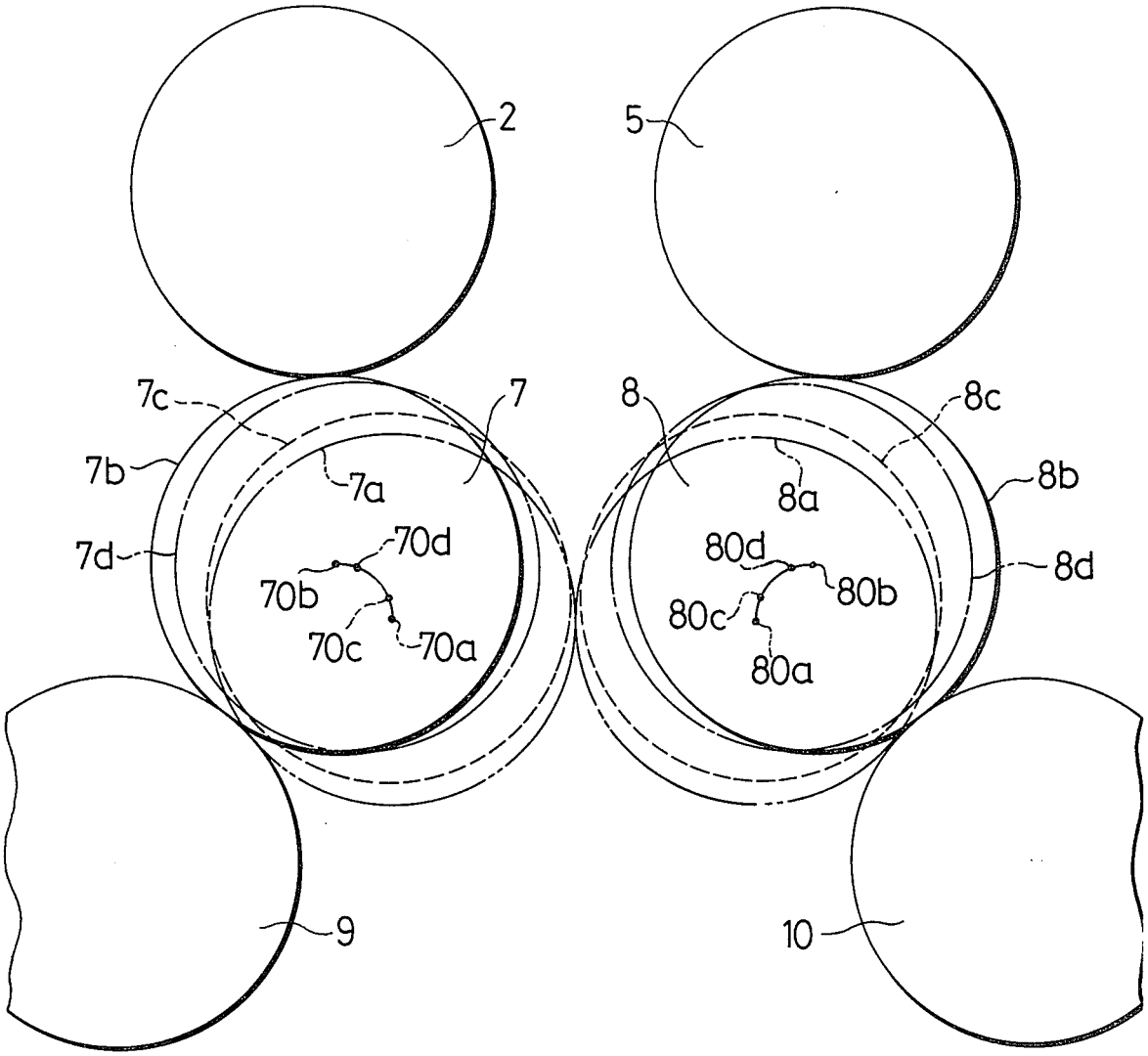
FIG. 6 is a enlarged illustration showing relative displacement of a pair of blanket cylinders at the time of switching between the first printing mode and the second printing mode.

In a first printing mode the blanket cylinders 7 and 8 of the four cylinder train unit are in a first position in which the blanket cylinders 7, 8 make contact with their respective plate cylinders 9, 10 and with each other, as shown by a solid line in FIG. 1, and also shown by a two dotted chain line in FIG. 6.

In a second printing mode the said blanket cylinders 7 and 8 are in a second position in which the blanket cylinders 7, 8 are isolated from each other, make contact with their respective plate cylinders 9, 10 and with their respective impression cylinder 2, 5 of the three cylinders train units, as shown by a broken line in FIG. 1 and also shown by a solid line in FIG. 6.

Numeral 37 shows a side frame. Ink furnishing rollers 11, 11, contact respectively with the plate cylinders 1, 4, 9 and 10, and said rollers 11, 11, contact respectively with inking cylinders 12, 12. The well-known means for furnishing ink also contact with the inking cylinders 12, 12, but they are not shown in the drawings. Water furnishing rollers 13, 13, contact respectively with the plate cylinders 1, 4, 9 and 10, and with the well-known means for furnishing water which are not shown in the drawings. A plurality of web guiding rollers 14, 14, are rotatably projected from the frame 37.

Figure 2:
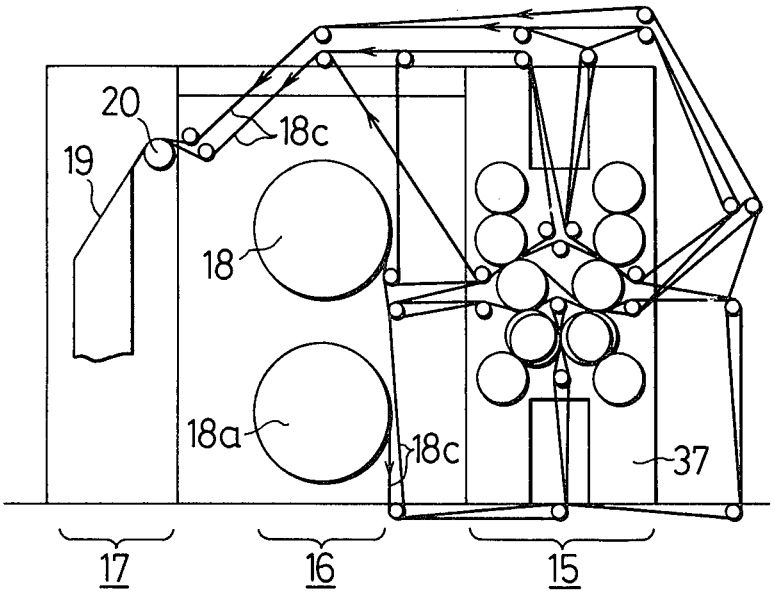
FIG. 2 is an illustration of the positional relationship in the offset printing press according to this invention, of a web furnishing machine provided as a before step thereof and a web folding machine provided as an after step thereof.

FIG. 2 shows the positional relationship in the offset printing press 15 according to this invention, a web furnishing machine 16 being provided as a before step thereof and a web folding machine 17 being provided as an after step thereof.

The offset printing press 15 is furnished paper 18*c* from a web 18 or 18*a* in the web furnishing machine 16, and the paper 18*c* on which there has been finished printing is folded along the longitudinal direction by a former 19 provided in the web folding machine 17. Numeral 20 is a driving roller.

Figure 4:
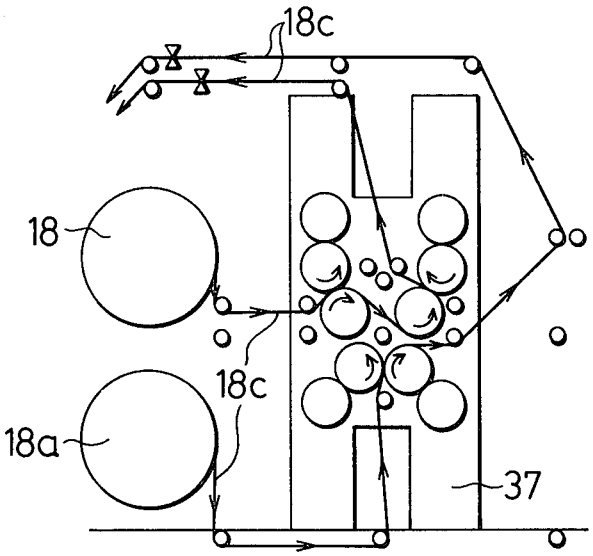

FIGS. 3 to 5 show various printing modes able to be achieved by the offset printing press according to this invention.

Figure 3A:
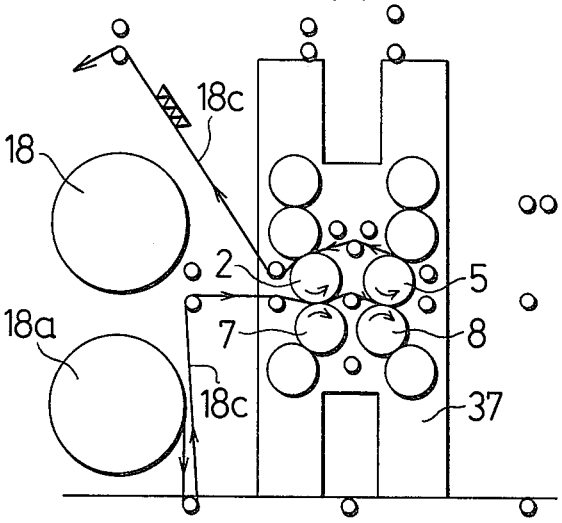
FIGS. 3A, 3B and 3C are illustrations according to a second printing mode.
Figure 3B:
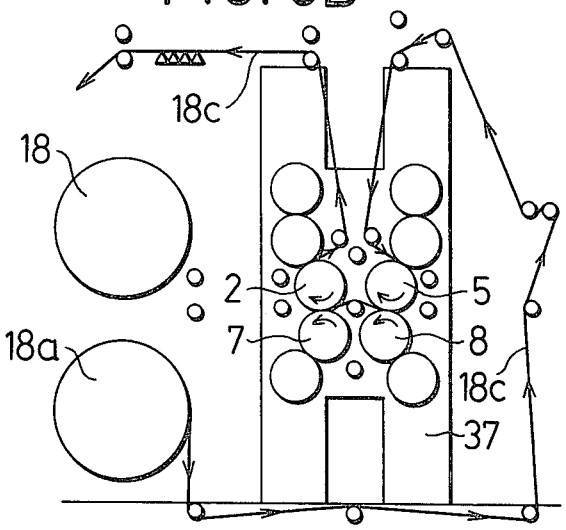
Figure 3C:
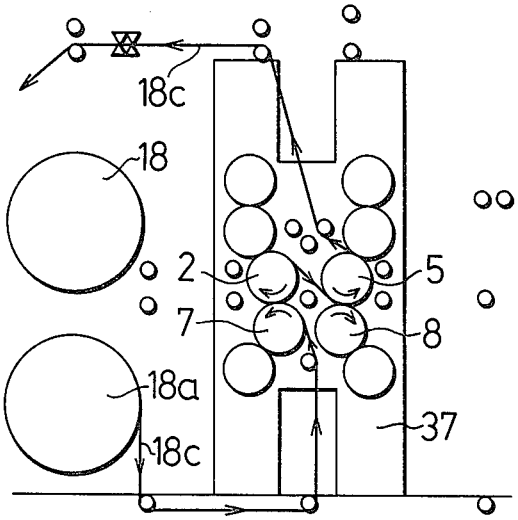

When the printing press works in the second position in which the blanket cylinders 7, 8 are isolated from each other and contact with the impression cylinders 2, 5 and with the plate cylinders 9, 10 respctively, the printing press can perform second printing modes i.e. quadruplicate printings on one side of a web 18*c* as shown in FIG. 3A, quadruplicate printings on the other side of the web 18*c* as shown in FIG. 3B, or duplicate printings on both sides of the web 18*c* as shown in FIG. 3C. Triangle marks of which the vertexes contact with one side of the web 18*c* show a quantity of overlapping print and a printed side of the web 18*c*.

Figure 3D:
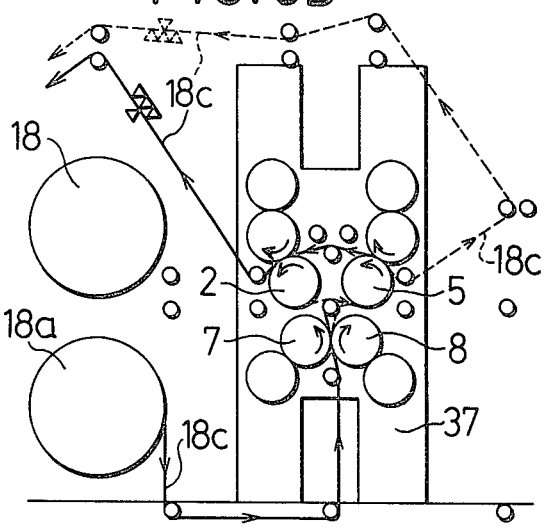
Figure 3E:
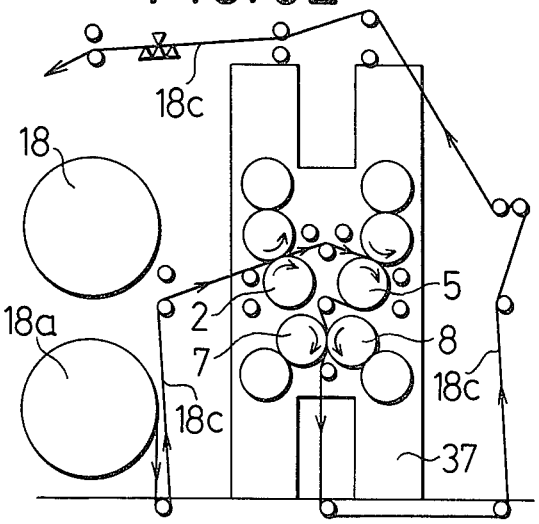
Figure 3F:
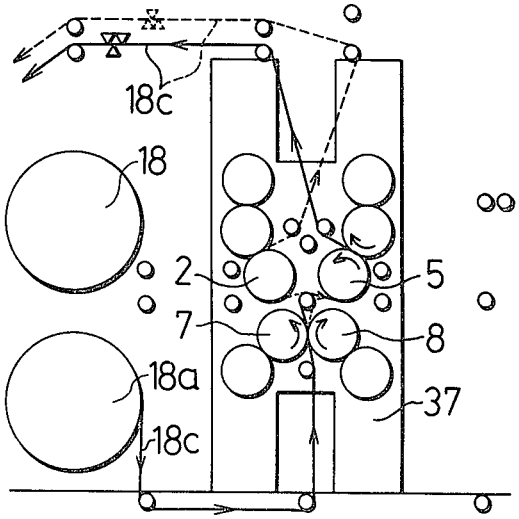

When the printing press works in the first position in which the blanket cylinders 7,8 contact with each other and with their respective plate cylinders 9, 10, and are isolated from the impression cylinders 2, 5, the printing press can perform first printing modes, i.e. triplicate printings on one side and monochromatic printing on the other side as shown by a solid line in FIG. 3D, monochromatic printing on one side and triplicate printings on the other side as shown by a broken line in FIG. 3D and by a solid line in FIG. 3E, duplicate printings on one side and monochromatic printing on the other side as shown by a solid line in FIG. 3F, monochromatic printing on one side and duplicate printings on the other side as shown by a broken line in 3F, or monochromatic printing on each of both sides of the two webs 18 and 18*c* performing at the same time as shown in FIG. 4.

Figure 5A:
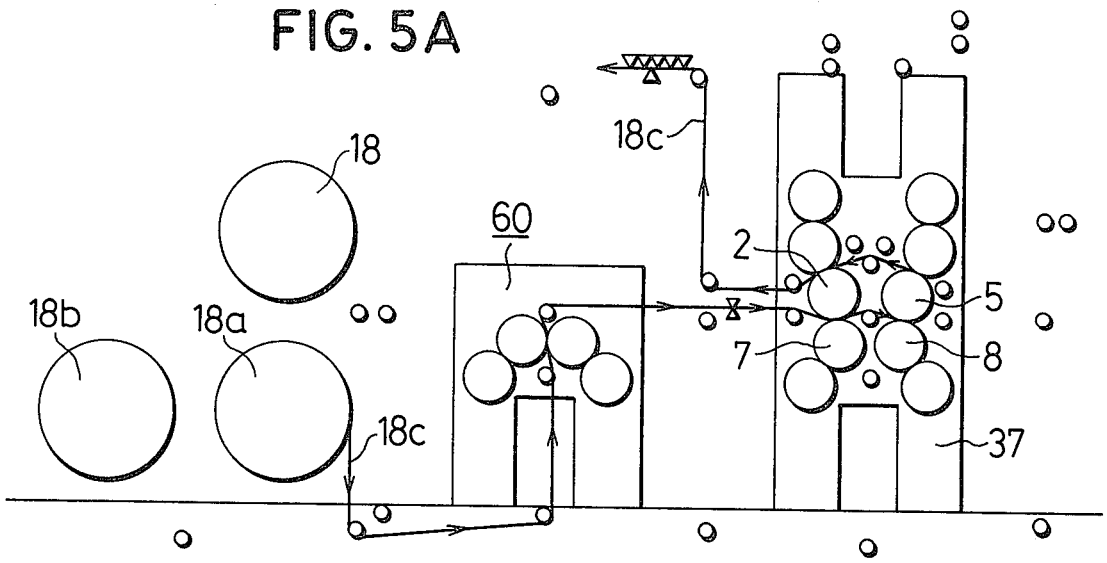
FIG. 5A shows a state of quintuplicate printings on one side and monochromatic printing on the other side of a web, by adding a four cylinder train unit to the second printing mode.
Figure 5B:
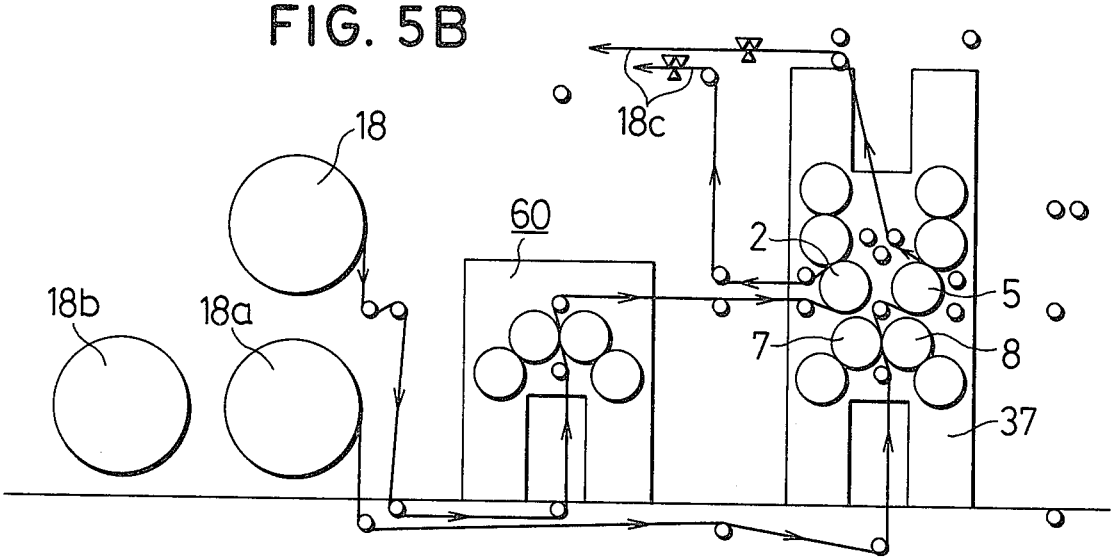
FIG. 5B shows a state of duplicate printings on one side and monochromatic printing on the other side of two webs, by adding a four cylinder train unit to the first printing mode.
Figure 5C:
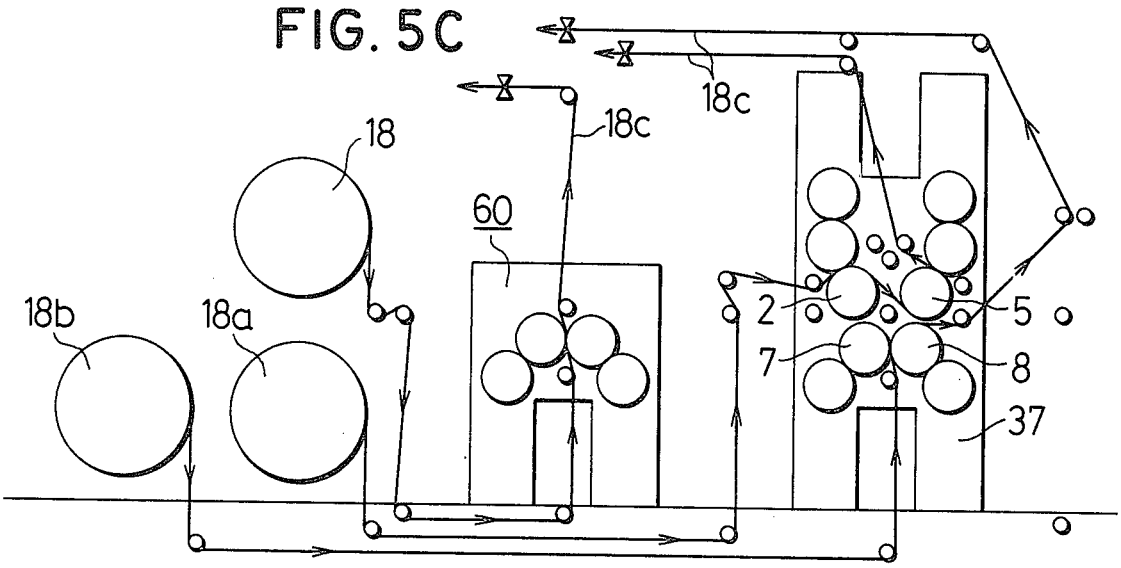
FIG. 5C shows a state of monochromatic printing on both sides of three webs, by adding a four cylinder train unit to the first printing mode, whereby printings consisting of 24 pages are achieved at the same time via 8 pages per a web.

In case of additionally adding a four cylinder train unit to the printing press according to this invention it can perform quintuplicate printings on one side and monochromatic printing on the other side as shown in FIG. 5A, duplicate printings on one of the sides and monochromatic printing on the both other sides of two webs at the same time as shown in FIG. 5B, or monochromatic on both sides of three webs at the same time as shown in FIG. 5C.

As shown in FIG. 6, in order to change the printing modes the blanket cylinders 7, 8 are switched between two extreme positions i.e. the first position 7*a*, 8*a* and the second position 7*b*, 8*b* whereby axles of the blanket cylinders 7, 8 are each displaced along symmetrical arcs 70*a*, 70*c*, 70*d*, 70*b* and 80*a*, 80*c*, 80*d*, 80*b*.

Because of the fact that the blanket cylinders 7, 8 in the present invention contact independently with their respective different impression cylinders 2 and 5 in comparison with the conventional arrangement of cylinders which contact with their common and single impression cylinders, an advantage of the present invention is that, not only is it permitted to adopt enough length to be sufficient for quantity of the displacement thereof, but also it is not always required to rotate in reverse direction one of the blanket cylinders and the cooperative plate cylinder thereof at each time of switching between the two extreme positions as shown in FIGS. 3C and 3F.

In case that it is required to rotate in reverse direction by means of shifting gears at each time of switching between the two extreme positions as shown in FIGS. 3A, 3B, 3D, 3E and 3F, nevertheless, it is permitted to adopt enough length in connection with bodily swinging of the blanket cylinders 7, 8, so that the reverse rotation by means of shifting gears in the present invention can be effected easily and exactly by a very simple and well-known arrangement of the gears not shown in the accompanying drawings, without a complicated arrangement of the gears as in the conventional shifting method.

On the other hand, all of the intermediate positions 70*c*, 70*d* and 80*c*, 80*d* which are necessary for the impression throw off exist at the intermediate points on the arc lines on which the axles of the blanket cylinders 7, 8, move between the two extreme positions.

The blanket cylinders in the conventional switching method stay at, and move to relayed positions from the intermediate positions peremptorily at each shifting in spite of whether there is impression throw-off or not.

The intermediate positions in the present invention are not the relaying points but pass-through points merely, and the blanket cylinders are diverged (branched off) to the intermediate position from each extreme position in so far as the impression throw-off is required.

Means for switching the two blanket cylinders 7, 8 and means for moving the blanket cylinders to the intermediate positions between the two extreme positions are explained in the below-mentioned description.

Referring to FIGS. 7, 8, 9 and 10, two blanket cylinders 7 and 8 are both supported by eccentric sleeves 21 and 22, respectively. Bracket 23 and 24 are extended from the respective eccentric sleeves 21 and 22. A pair of links 25 and 26 are supported at one end on respective brackets by means of pivots 27 and 28. One of these links 25 is pivoted at its other end to a connecting piece. A dog-leg-shaped link 32 is pivoted to a pivot 31 which is provided also on the connecting piece 29.

Figure 7:
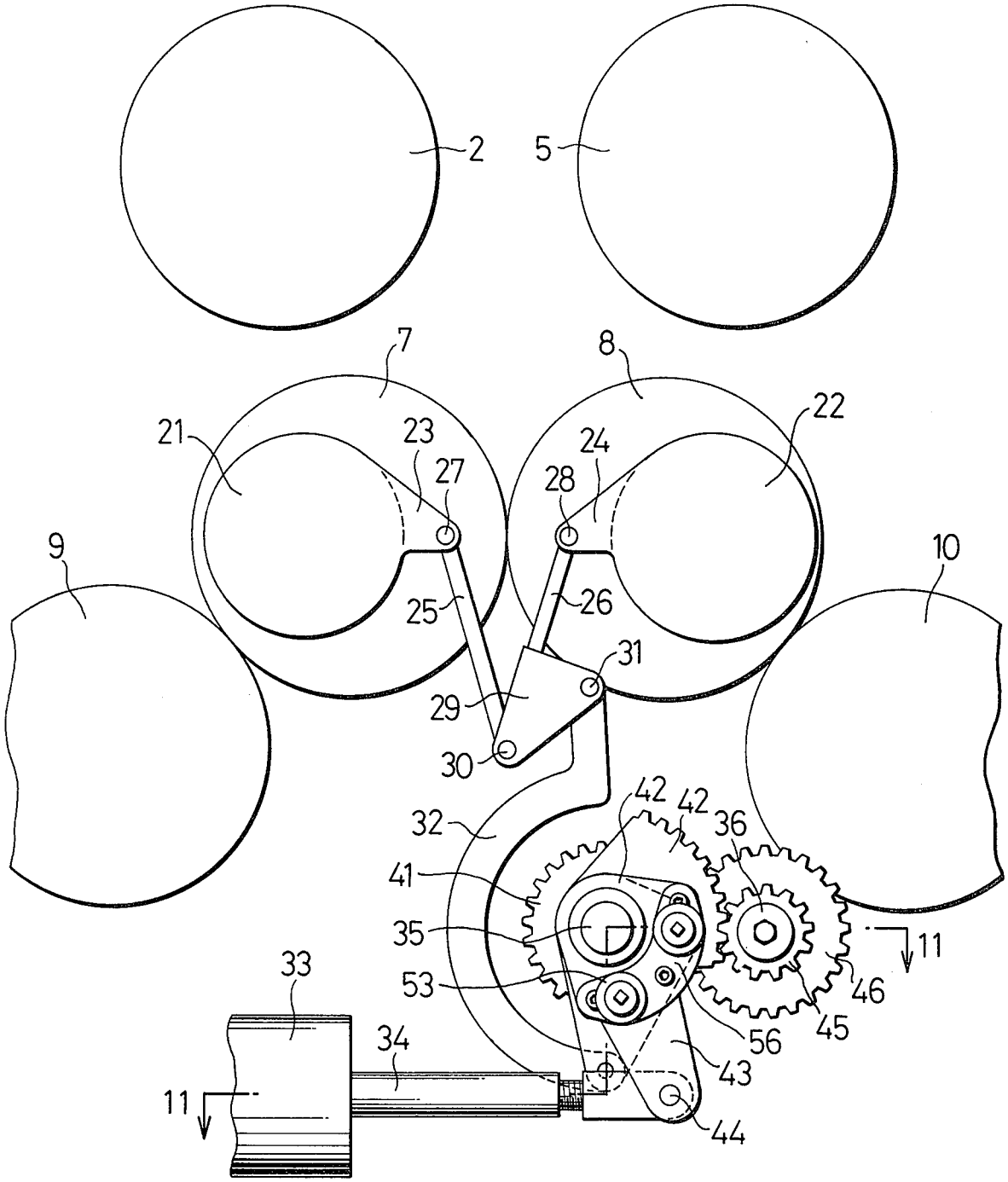
FIG. 7 is an illustration showing the positional relationship of essential parts of the pair of the blanket cylinders shifting mechanism in the first printing mode.

As shown in FIG. 7, as the dog-leg-shaped link 32 is pulled to one extreme position, the pair of links 25 and 26 are moved toward each other to form a V-shape, and the pair of eccentric sleeves 21 and 22 are rotated in the opposite directions by an equal angle. As a result, the blanket cylinders 7 and 8 are made to contact each other, and are isolated from the impression cylinders 2 and 5 respectively, thus achieving the connection of four cylinders 9, 7, 8 and 10. This is a first position.

Figure 8:
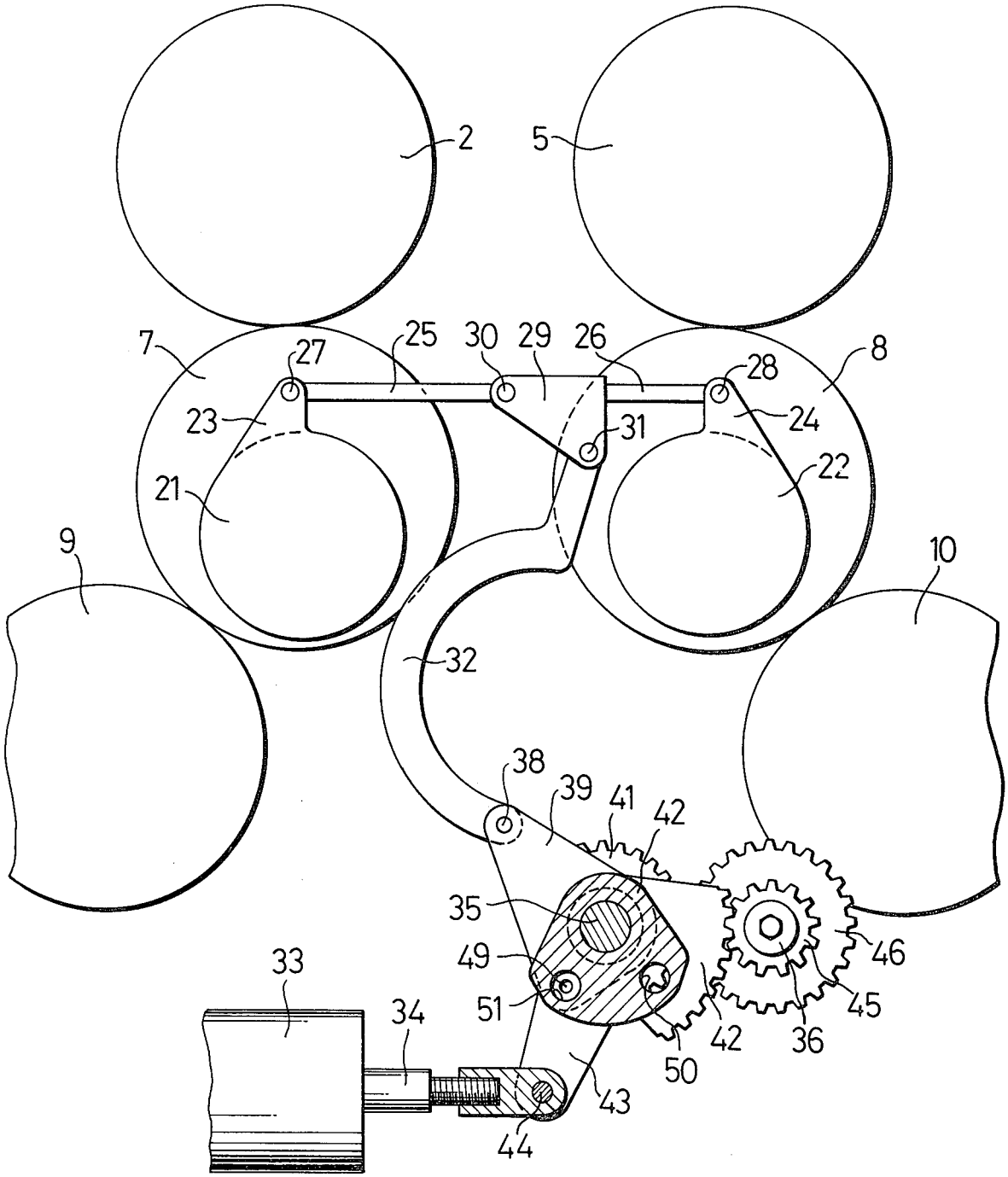
FIG. 8 is an illustration showing the positional relationship of essential parts of the pair of blanket cylinders shifting mechanism in the second printing mode.

On the other hand, as shown in FIG. 8, as the dog-leg-shaped link 32 is moved to the other extreme position, the pair of links 25 and 26 are moved away from each other to extend linearly, and the pair of eccentric sleeves 21 and 22 are rotated in the opposite directions by an equal angle, so that the blanket cylinders 7 and 8 are moved away from each other. As a result, a pair of five cylinder trains 1, 3, 2, 7, 9 and 4, 6, 5, 8, 10 are achieved.

The movement of the dog-leg-shaped link 32 is caused by the piston rod 34 on an actuator 33. However, it is difficult to cause a large angular displacement of the eccentric sleeves 21, 22 between one extreme position (See FIG. 7) and the other extreme position (See FIG. 8) at once by a single stroke of the small pneumatic cylinder 33, if the starting end of the link 32 is merely connected to the end of the rod 34 in an ordinary way.

According to the invention, this problem has been overcome by providing a geared angle increase shifting mechanism between the starting end of the link 32 and the end of the rod 34.

Figure 11:
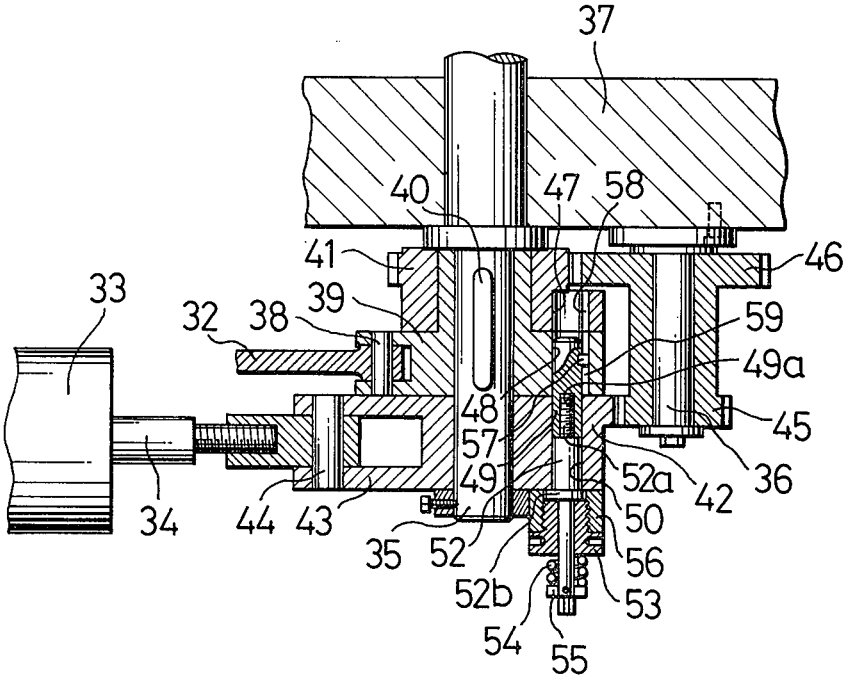
FIG. 11 is a sectional plan view taken along the line 11—11 of FIG. 7, showing a clutch pin shifted to a position where it permits the impression throw-off of the blanket cylinders.
Figure 12:
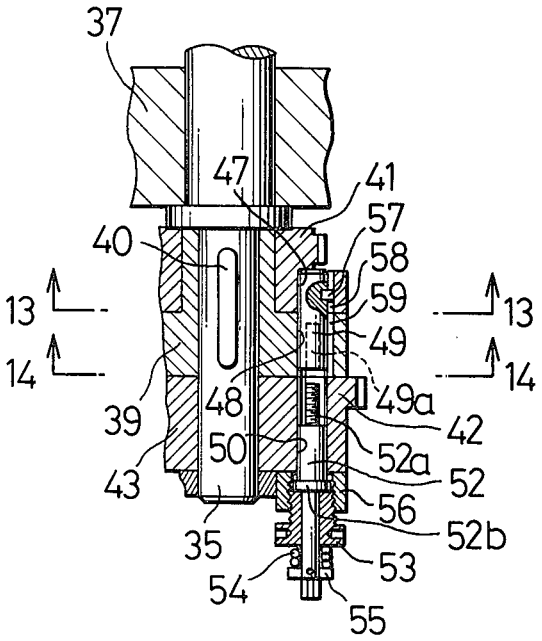
FIG. 12 is a sectional plan view of an essential part of FIG. 11, showing the clutch pin shifted to a position where it permits the switching of the printing mode.
Figure 13:
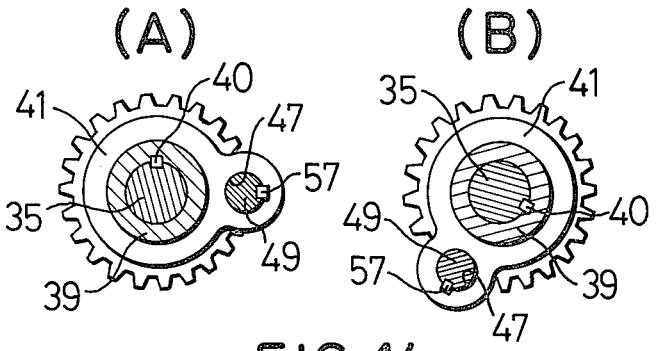
FIGS. 13A and 13B are longitudinal sectional views taken along the line 13—13 of FIG. 12, FIGS. 14A and 14B are longitudinal sectional views taken along the line 14—14 of FIG. 12, where
Figure 14:
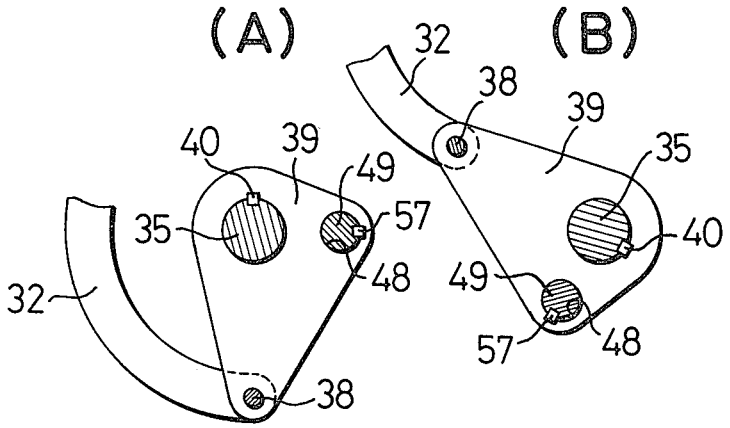
Figure 15:
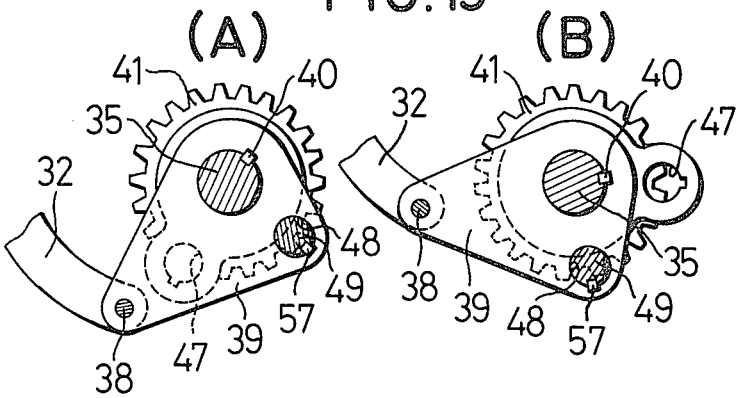

As shown in FIGS. 11 and 12, the main shaft 35 of the angle increase mechanism extends through the operating side of a side frame 37, and is rotatably supported by the latter. The main shaft 35 further extends through and is supported by the other side frame which is not shown, so as to cause the angle increase shift of the other link mechanism which has been omitted in the drawings. A sub shaft 36 is fixed to the outer surface of the side frame 37, by means of screws.

The starting end of the link 32 is connected to one apex of a triangular driven disc 39, by a pivot 38. The driven disc 39 is supported at its center to the main shaft 35 by means of a key 40. The arrangement is such that the angular displacement of the driven disc 39 is transmitted to the main shaft 35 through the key 40 and then to the driven disc of the opposite side which is not shown to impart the same angular displacement to the latter.

Between the driven disc 39 and the side frame 37, there is disposed a driven gear 41 which is rotatable around the axis of the shaft 35. In the illustrated embodiment, the driven disc 39 and the driven gear 41 are provided separately for independent angular movement, so as to afford the intermediate mode, i.e. the impression throw off. However, if such an intermediate mode is not necessary, they may be constructed unitarily with each other.

A prime mover segment gear 42 rotatable relatively to the main shaft 35 is attached to the outside of the driven disc 39. An arm 43 unitary with the segment gear 42 is extended at a constant angle to the main shaft 35. The end of the arm 43 is pivoted by a pivot 44 to the corresponding end of the piston rod 34 of the air cylinder 33.

Two relay gears 45, 46 unitary with each other are mounted on the sub shaft 36 for free rotation relatively to the latter. These relay gears have different diameters. The smaller and larger gears 45 and 46 are engaged by the prime mover segment gear 42 and the driven gear 41, respectively.

If the driven disc 39 and the driven gear 41 are made unitary, and if the ratio of rotation of the prime mover segment gear 42 to the driven gear 41 is selected to be 1:2, an angular displacement which is two times as large as that of the prime mover segment gear 42 is imparted to the driven disc 39. Consequently, a displacement which is two times as large as that of the stroke of the rod 34 of the pneumatic cylinder 33 is given to the dog-leg-shaped link 32. Needless to say, a displacement three times as large as that of the stroke of rod 34 can be obtained by selecting the rotation ratio to be 1:3.

Figure 9:
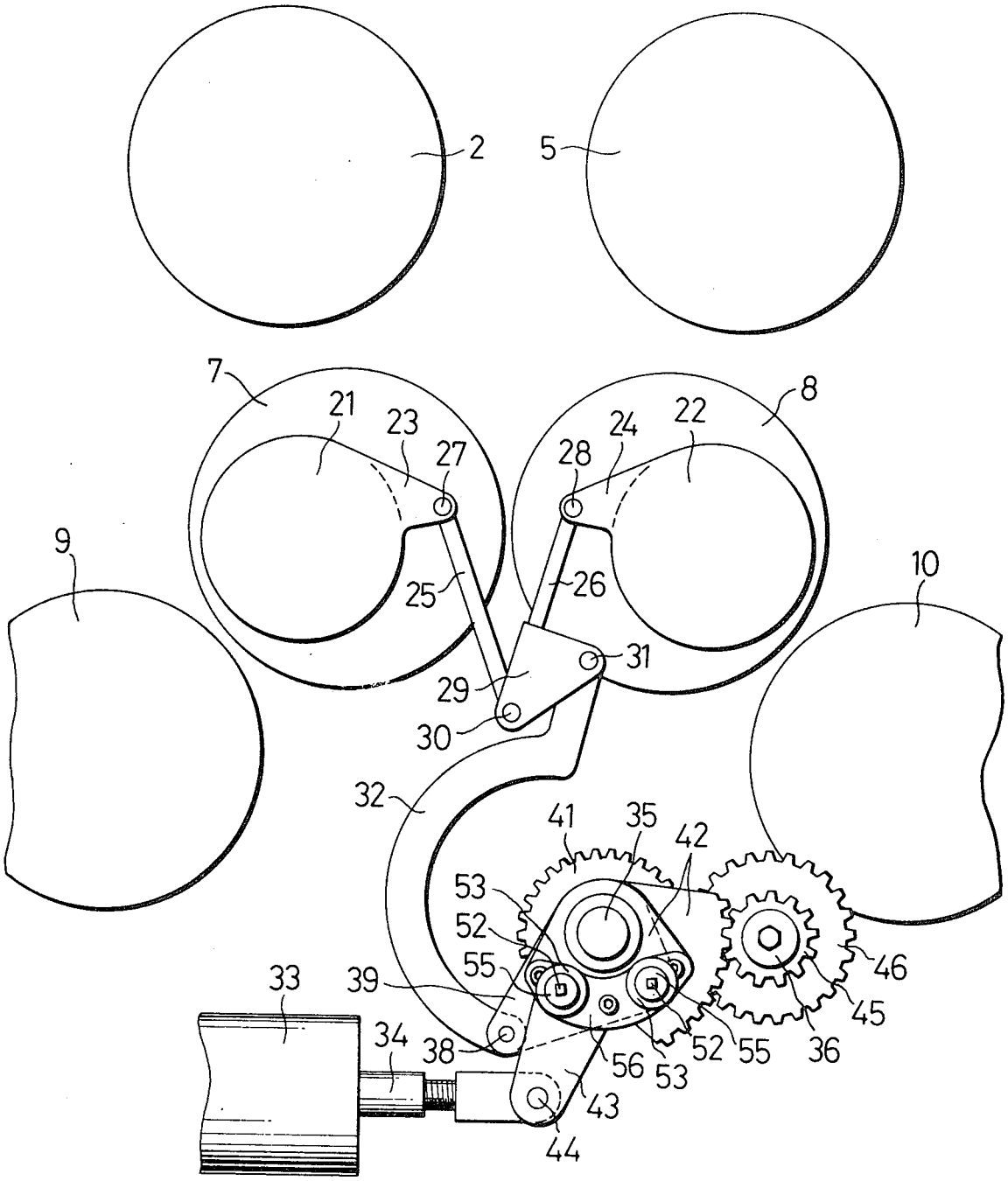
FIG. 9 is an illustration showing the positional relationship of essential parts of the pair of the blanket cylinders shifting mechanism when an impression throw-off of the blanket cylinders is made from the state of FIG. 7.
Figure 10:
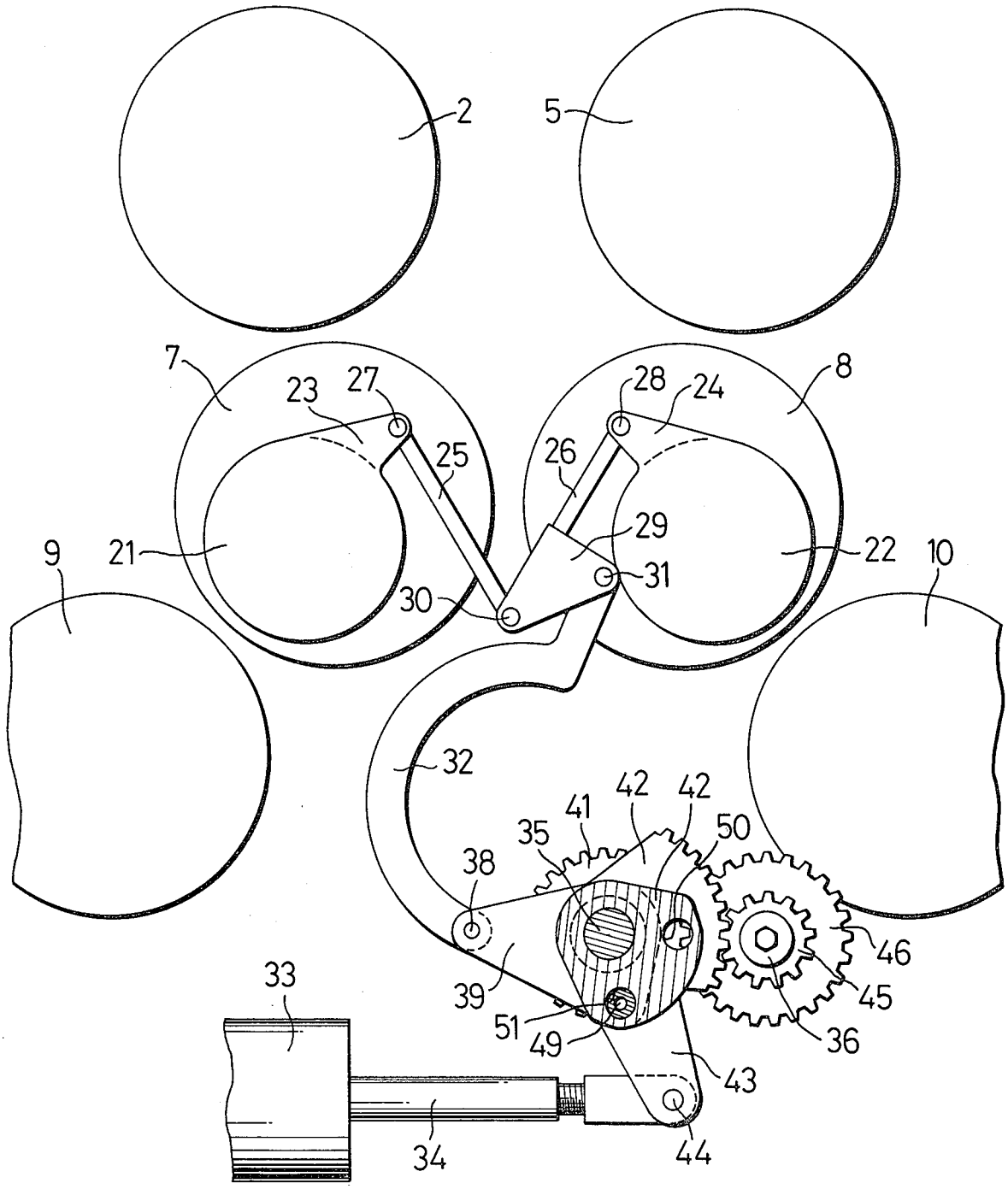
FIG. 10 is an illustration showing the positional relationship of essential parts of the pair of the blanket cylinders shifting mechanism when an impression throw-off of the blanket cylinders is made from the state of FIG. 8.

According to the invention, the blanket cylinders 7 and 8 are adapted to take, in addition to both extreme positions, an intermediate mode, i.e. a state of impression throw off as shown in FIGS. 9 and 10 in which the blanket cylinders 7 and 8 are kept out of contact with all other cylinders. This is achieved by a pin clutch mechanism as described below.

Referring to FIGS. 11 to 15, bores 47 and 48 are formed in the driven gear 41 and the driven disc 39, respectively. With these bores aligned with each other, a common clutch pin 49 is inserted into both bores as shown in FIG. 12. As a result, the driven gear 41 and the driven disc 39 are connected unitarily to each other, so that the angular displacement which is, for example, three times as large as that of the driven gear 41 is directly transmitted to the disc 39. As the clutch pin 49 is withdrawn from the bore 48 of the driven disc 39 as shown in FIG. 11, the angular displacement of, for example, three times that of the driven gear 41 is not transmitted to the driven disc 39.

Instead, when the driven disc 39 and the driven gear 41 are not connected to each other, the same angular displacement as that of the prime mover segment gear 42 is transmitted directly to the driven disc 39, if the clutch pin 49 is operated so as to unitarize the driven disc 39 and the prime mover segment gear 42 with each other, as shown in FIG. 11. As a result, the displacement of the dog-leg-shaped link 32 connected to the driven disc 39 is reduced to $\frac{1}{3}$ of that obtained by the above-described engagement. It is therefore possible to set the pair of blanket cylinders 7 and 8 at the intermediate mode as shown in FIGS. 9 and 10.

For the sake of explanation, it is assumed here that the ratio of rotation of the prime mover segment gear 42 to the driven gear 41 is 1:3. Also, an assumption is made that the stroke length of the piston rod 34 of the pneumatic cylinder 33 corresponds to an angular displacement of 40° of rotation around the axis of the main shaft 35. In such a case, the driven gear 41 is rotated by 120° from the position as shown in FIG. 13A to the position as shown in FIG. 13B, by a single stroke of the rod 34. Then, the driven disc 39 which has been made unitary with the driven gear 41 by the insertion of the clutch pin 49 is rotated also by 120° from the position as shown in FIG. 14A to the position as shown in FIG. 14B. In the course of this displacement, however, prime mover segment gear 42 is rotated only by $\frac{1}{3}$ of the above stated angular displacement, i.e. only by 40°. Thus, a phase differential of 80° is caused between the rotation of the driven gear 41 and the prime mover segment gear 42, for one stroke of the rod 34.

For this reason, as will be seen from FIGS. 8 and 10, bores 50 and 51 for receiving the clutch pin 49 are formed in the prime mover segment gear 42 at an angular difference of 80° around the axis of the main shaft 35. More specifically, one bore 50 is positioned to align with the clutch pin insertion bores 47 and 48 of the driven gear 41 and the driven disc 39, when the gear and disc are positioned as shown in FIGS. 13A and 14A, respectively, while the other bore 51 is adapted to align with the pin insertion bores 47 and 48, when the driven gear 41 and the driven disc 39 are positioned as shown in FIGS. 13B and 14B.

At the outer ends of the pair of clutch pin insertion bores 50 and 51 provided in the prime mover segment gear 42 are provided an operative mechanism for longitudinally actuating the clutch pin 49. FIGS. 11 and 12 show only one of these mechanisms located closer to the insertion bore 50. The other of the mechanisms is omitted from the drawings, because it has a construction strictly identical with the illustrated one.

Referring to FIGS. 11 and 12, a clutch pin operating rod 52 is received by the bore 50. A male screw rod **52*a* is formed at the end of the rod 52. The male screw rod 52*a* is adapted to be screwed into a female screw bore 49*a* formed in the clutch pin 49 in the longitudinal direction of the latter. A flange 52*b* of a diameter larger than that of the bore 50 is formed at the intermediate portion of the operating rod 52. A sleeve 53, a coiled spring 54 and a spring retainer 55 are attached in the mentioned order to the head of the operation rod 52. The sleeve 53 is threaded at its outer peripheral surface for engagement with an internal threaded bore of an arc-shaped plate 56 which is fixed by bolts along the outer surface of the bores of the segment gear 42, whereby the clutch pin actuating mechanism as a whole is attached to the opening of the bore 50**.

On the other hand, since any rotation of the clutch pin 49 during the operation causes an operation failure, the clutch pin 49 is provided with means for allowing only the longitudinal movement thereof but preventing the rotation of the same. Namely, a rotational prevention pin 57 for preventing the rotation of the clutch pin 49 is extended laterally from the pin 49 and is received and guided by guided grooves 58 and 59 which are formed in the inner walls of the bores 47 and 48 in the longitudinal direction of the latter.

The switching operation of the pair of blanket cylinders 7 and 8 according to the invention is executed in the following manner.

In cse of the printing modes in which the impression throw off is not necessary, it is not necessary to provide the pin clutch mechanism, and the driven gear 41 and the driven disc 39 can be formed unitarily with each other. The switching between the first extreme position in which, as shown in FIG. 7, the blanket cylinders 7 and 8 make contact with each other, and the second extreme position in which, as shown in FIG. 8, the blanket cylinders 7, 8 make contact with the impression cylinders 2, 5 is effected by one stroke of operation of the rod 34 of pneumatic cylinder 33 between the fully extended position (See FIG. 7) and the fully retracted position (See FIG. 8). This single motion is amplified by the angle increase shifting machanism and transmitted to the dog-leg-shaped link 32, so as to drive both blanket cylinders 18 and 19 directly from their one extreme positions to the other extreme positions.

In case of the printing modes which requires an intermediate mode, the driven gear 41 and the driven disc 39 are made separate, and the pin clutch mechanism which allows the selective engagement of the driven disc 39 with the driven gear 41 and with the prime mover segment gear 42 is effectively used as in the illustrated embodiment.

For the switching from one to the other of the extreme positions, as shown in FIG. 12, the head of the clutch operation rod 52 is rotated in the counter-clockwise direction by a tool. As a result, the male screw rod **52*a* of the operating rod 52, which has been engaged by the female screw bore 49*a* of the clutch pin 49, is driven out of the bore 49*a*. Thanks to the provision of the rotation prevention pin 57 which engages the pin guide grooves 58 and 59, the clutch pin 49 is not rotated in the bore 47 but slid in the longitudinal direction. The male screw rod 52***a* is withdrawn from the female screwed bore 49*a* in the clutch pin 49, so that the both are separated from each other. However, longitudinal displacement of the clutch pin 49 has not yet been enough. Pushing the clutch operation rod 52 to the longitudinal direction against the force of the spring 54, the clutch pin 49 is further inserted in the inner direction by the front end of the male screw rod 52*a*. When, releasing the pushing force, only the clutch operating rod 52 returns by the force of the spring 54. Thus, the clutch pin 49 comes out of the bore 50 of the segment gear 42 as shown in FIG. 12. In this state, the clutch pin is received only by the bore 47 of the driven gear 41 and the bore 48 of the driven disc 39. Once this state has been obtained, the switching of the blanket cylinders 7 and 8 between their extreme positions can be achieved as shown in FIGS. 7 and 8, as the pneumatic cylinder 33 is actuated to cause a travel of the piston rod 34 over the full stroke.

In this switching between two extreme positions of the printing cylinders, the clutch pin 49, which is received by the insertion bores 47 and 48 of the driven gear 41 and the driven disc 39, takes the angular positions as shown in FIGS. 13A and 13B. An angular difference of 120° exists between these positions, due to the operation of the geared angle tripling mechanism. However, the prime mover segment gear 42 in the meantime makes an angular displacement which is only $\frac{1}{3}$ of the above-mentioned angular difference, i.e. an angular displacement of only 40°. Therefore, one of the clutch pin insertion bores 50, which has aligned in the state of FIG. 7 with the bore 48 of the driven disc 39, is stopped at an angular position 40° as shown in FIG. 8, while the bore 48 of the driven disc 39 in the 120° advanced position comes into alignment with the other clutch pin insertion bore 51 of the prime mover segment gear 42.

Therefore, for switching the blanket cylinders from the second position 7*b*, 8*b* to the second intermediate position 7*d*, 8*d* as shown in FIG. 6, the clutch pin actuating mechanism provided on the other clutch pin insertion bore 51 of the prime mover segment gear 42 is operated to shift the clutch pin 49 from the position as shown in FIG. 12 to the position as shown in FIG. 11, out of the bore 47 of the driven gear 41, until the pin comes to be received by the bore 48 of the driven disc 39 and the segment gear 42 which are coupled to each other. Then, as the rod 34 of the pneumatic cylinder 33 is fully extended from the position as shown in FIG. 8 to the position as shown in FIG. 10, an angular displacement of 40° which is $\frac{1}{3}$ of the angular displacement between the extreme positions is imparted to the driven disc 39, so as to achieve the state of intermediate position (See FIGS. 10 and 15B).

The resetting from the second intermediate position as shown in FIG. 10 is possible only to the second position as shown in FIG. 8, and the direct resetting to the first position of FIG. 7 is not allowed.

In contrast, for causing a shift from the first position 7*a*, 8*a* as shown in FIG. 6 to the first intermediate position 7*c*, 8*c*, the clutch pin actuating mechanism provided on one clutch pin insertion bore 50 of the segment gear 42 is operated, as shown in FIG. 11, so as to move the clutch pin 49 from the position as shown in FIG. 12 to the position as shown in FIG. 11, thereby to directly couple the driven disc 39 and the segment gear 42 to each other. Then, as the rod 34 of the pneumatic cylinder 33 is retracted by one stroke from the position of FIG. 7 to the position of FIG. 9, an angular displacement which amounts to $\frac{1}{3}$ of the angular displacement between two extreme positions of 120°, i.e. an angular displacement of 40°, is imparted to the driven disc 39, so as to set the cylinders in the first intermediate position (See FIGS. 9 and 15A).

The resetting of the cylinders from the first intermediate position as shown in FIG. 9 is allowed only to the first position 7*a*, 8*a* as shown in FIG. 6 Thus, the resetting to the second position 7*b*, 8*b* from this state is not permitted.

Figure 16:
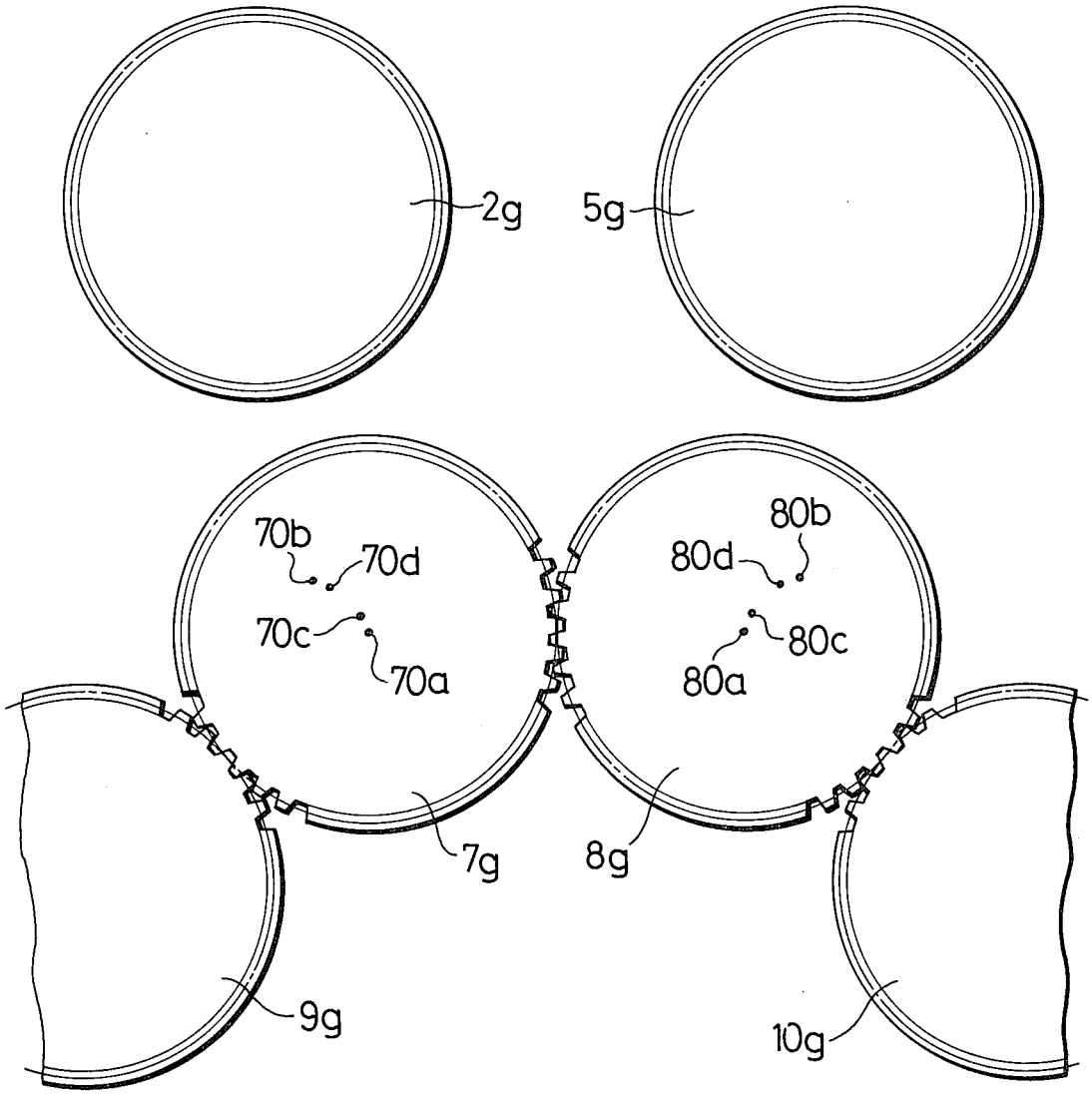
FIG. 16 is an illustration showing a gear train for driving the four cylinder train unit at the first position shown by FIG. 7.

As shown in FIG. 16 a gear train is formed at the first position which consists of a pair of gears 7*g*, 8*g* for driving the pair of the blanket cylinders 7, 8 and which make engagement with each other and with a pair of gears 9*g*, 10*g* for driving the pair of plate cylinders 9, 10 and are isolated from gears 2*g*, 5*g* for driving their respective impression cylinders 2 and 5 of the three cylinder train units.

Figure 17:
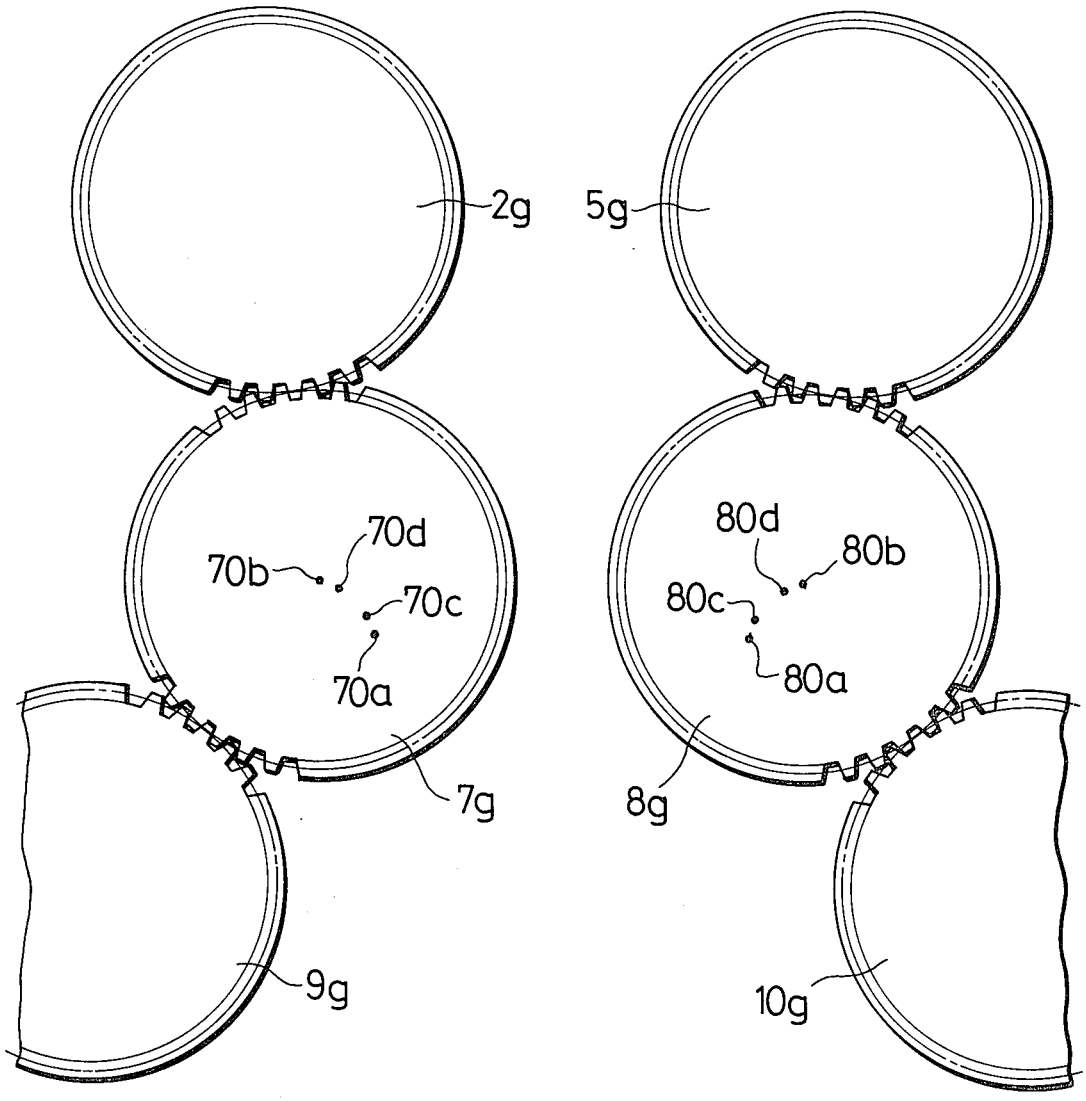
FIG. 17 is an illustration showing a pair of gear trains for driving the pair of the blanket cylinders of the four cylinder train unit which are isolated from each other and make engagement with gears for driving their respective plate cylinders and with gears for driving their respective impression cylinders of the three cylinder train units at the second position shown by FIG. 8.

As shown in FIG. 17 a pair of gear trains at the second position one of which consists of a gear 9*g* for driving the plate cylinder 9 and a gear 2*g* for driving the impression cylinder 2 with a gear 7*g* for driving the blanket cylinder 7 which is between and in engagement with both of them, and the other consists of a gear 10*g* for driving the plate cylinder 10 and a gear 5*g* for driving the impression cylinder 5 with a gear 8*g* for driving the blanket cylinder 8 which is between and engagement with both of them. And these engagements are isolated from each other between gears 7*g*, 8*g* for driving the blanket cylinders 7 and 8.

Figure 18:
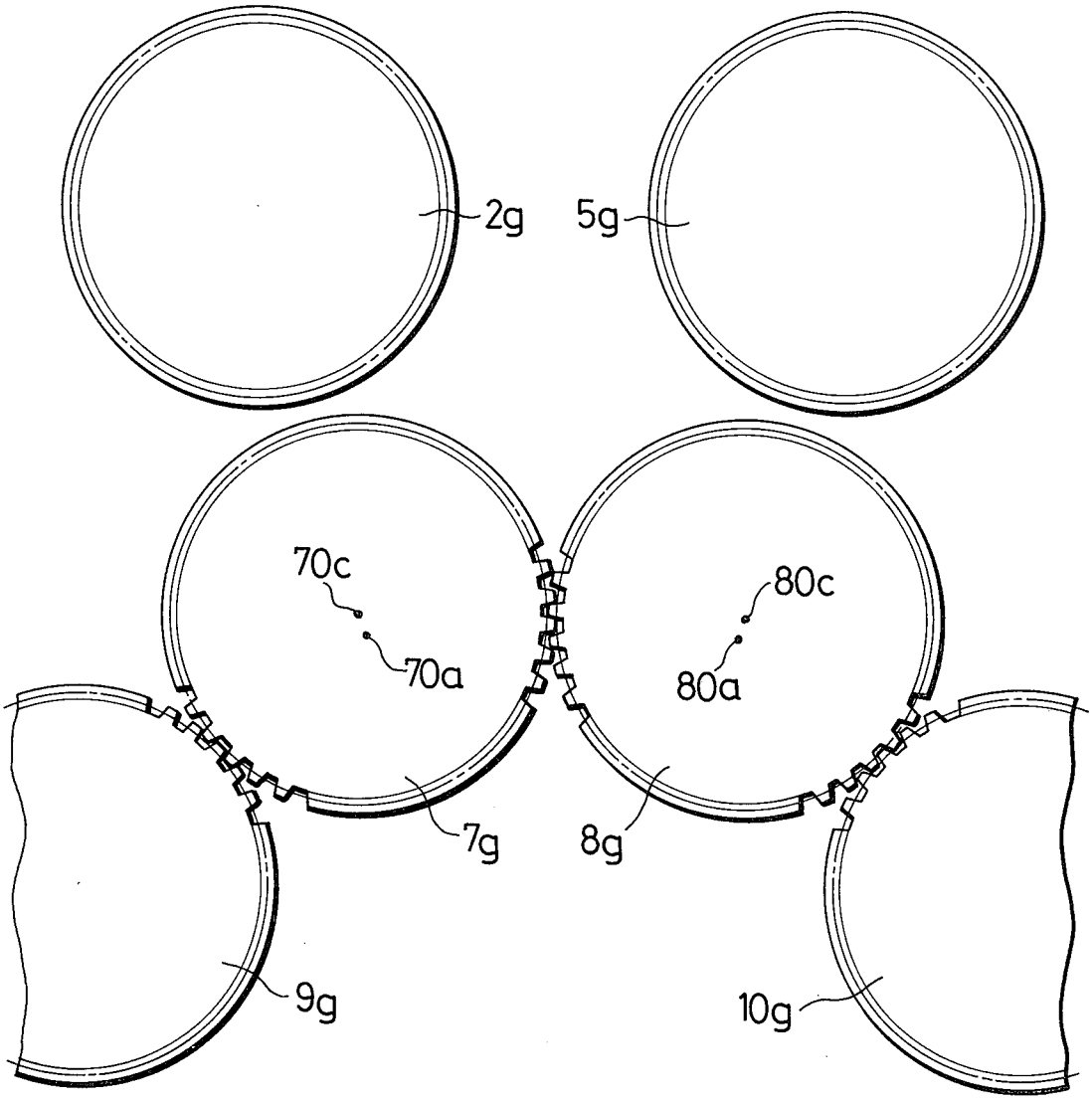
FIG. 18 is an illustation showing the state of a half engagement of the gear train for driving the four cylinder train unit at the first intermediate position shown by FIG. 9.

Referring to FIG. 18, in order to prevent any racing of the cylinders in the throw-off position, the first intermediate position 7*c*, 8*c* is defined within the range keeping engagement of a four gear train 9*g*, 7*g*, 8*g* and 10*g*, but it is out of the regular engagement of the pitch circle of the gear train.

Figure 19:
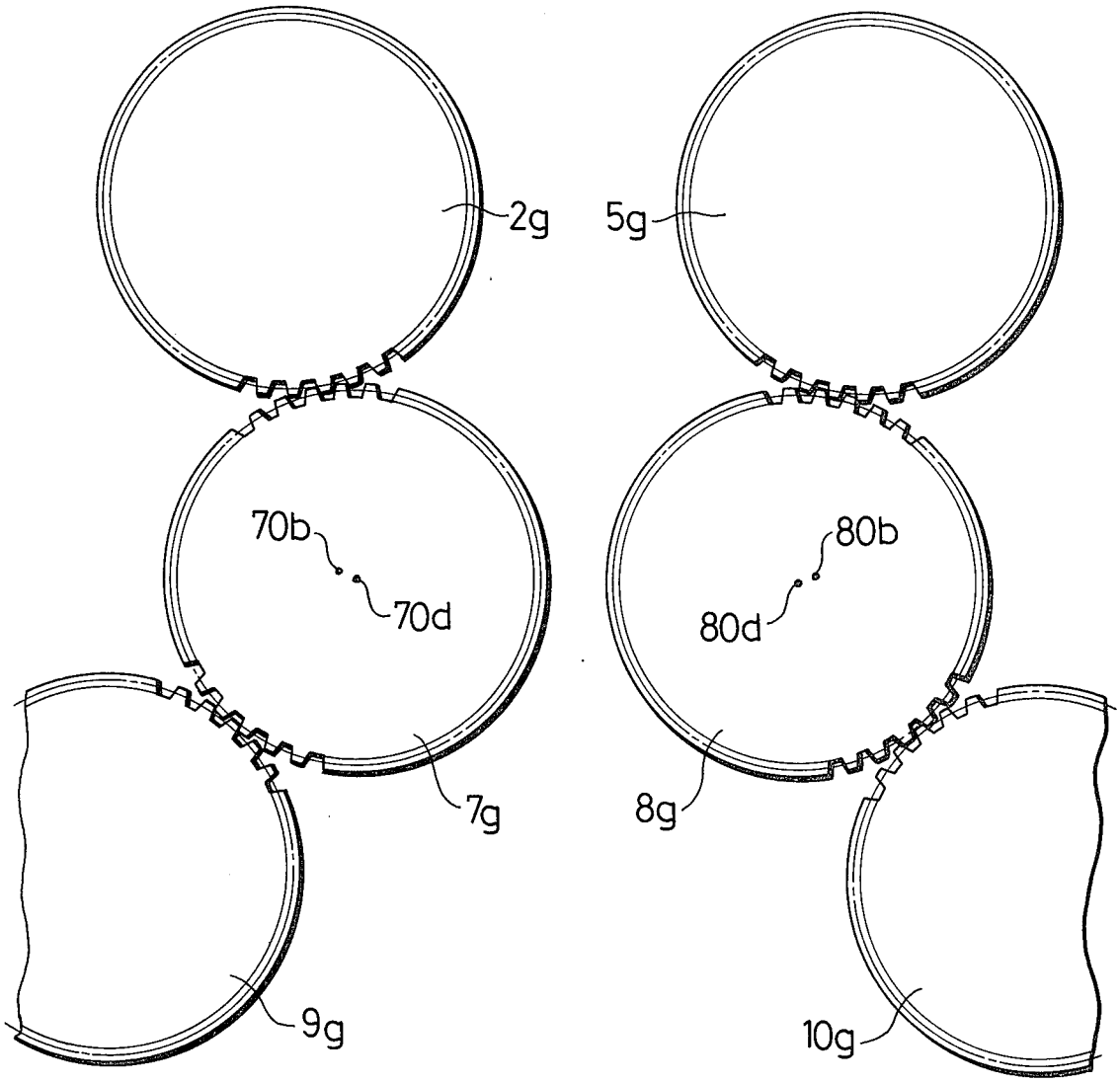
FIG. 19 is an illustration showing the state of a half engagement of the pair of gear trains at the second intermediate position shown by FIG. 10.

In the same way as the above description, as shown in FIG. 19, the second intermediate position 7*d*, 8*d* is defined within the range keeping engagements of a pair of three gear trains 9*g*, 7*g*, 2*g* and 10*g*, 8*g* 5*g*, but they are out of the regular engagement of the pitch circle of each gear train.

According to the invention, thanks to the use of the angle increase shifting mechanism making use of gears, the large angular displacements of the eccentric sleeves 21 and 22 required for the displacements of a pair of the blanket cylinders 7 and 8 can be performed at once by a single stroke of the piston rod 34 of the pneumatic cylinder 33 of a small size, and the switching of the blanket cylinders between one and the other extreme positions can be achieved without fail, promptly and easily. Thus, the apparatus of the invention can effectively be used in the switching of printing modes which does not require the intermediate position.

Further, according to the invention, the angle increase shifting mechanism is suitably combined with a pin clutch mechanism, so that the apparatus of the invention can be applied to the switching of printing modes which requires the intermediate position. Since the switching to the intermediate position is diverged from respective extreme positions, the cylinders are reset to the positions for the printing mode which is being conducted, safely, promptly and easily, after the completion of the work which requires the impression throw off, contributing greatly to the improvement of the printing work.

What is claimed is:

1. A multiple-purpose offset rotary printing press comprising:

a pair of three cylinder train units juxtaposed in symmetrical arrangement and each consisting of a plate cylinder and an impression cylinder with a blanket cylinder being between and contacting with both of them, a four cylinder train unit consisting of a pair of blanket cylinders contacting with each other at a position adjacent to both of the impression cylinders of the three cylinder train units and a pair of plate cylinders contacting with the pair of blanket cylinders for cooperating therewith respectively, and switching means for bodily moving each of the blanket cylinders of the four cylinder train unit through a short radius arc, comprising eccentric sleeves journalling the both axial ends of the blanket cylinders of the four cylinder train unit, a common operative link mechanism connected to the sleeves for rocking them simultaneously, an actuator, an angle increase shifting mechanism provided between said link mechanism and the actuator, said angle increase shifting mechanism comprising a main shaft and a sub shaft, both shafts being mounted on a frame, a driving gear rotatably mounted on the main shaft and adapted to follow the displacement of the actuator, a driven gear fixed on the main shaft and adapted to transmit a displacement to the link mechanism, and a pair of relay gears having different diameters fixed on the sub shaft, the relay gear of smaller diameter being in engagement with the driving gear and the relay gear of larger diameter being in engagement with the driven gear, whereby the blanket cylinders of the four cylinder train unit are moved between a first position and a second position by a single stroke of the actuator, the first position being that in which the blanket cylinders make contact with each other and with their respective plate cylinders and are isolated from their respective impression cylinders of the three cylinder train units, the second position being that in which the blanket cylinders are isolated from each other and make contact with their respective plate cylinders and with their respective impression cylinders of the three cylinder train units.

2. A multiple-purpose offset rotary printing press comprising:

a pair of three cylinder train units juxtaposed in symmetrical arrangement and each consisting of a plate cylinder and an impression cylinder with a blanket cylinder being between and contacting with both of them, a four cylinder train unit consisting of a pair of blanket cylinders contacting with each other at a position adjacent to both of the impression cylinders of the three cylinder train units and a pair of plate cylinders contacting with the pair of blanket cylinders for cooperating therewith respectively, and switching means for bodily moving each of the blanket cylinders of the four cylinder train unit through a short radius arc, comprising eccentric sleeves journalling the both axial ends of the blanket cylinders of the four cylinder train unit, a common operative link mechanism connected to the sleeves for rocking them simultaneously, an actuator, an angle increase shifting mechanism provided between said link mechanism and the actuator, said angle increase shifting mechanism comprising a main shaft and a sub shaft, both shafts being mounted on a frame, a driving gear rotatably mounted on the main shaft and adapted to follow the displacement of the actuator, a driven gear fixed on the main shaft and adapted to transmit a displacement to the link mechanism, a pair of relay gears having different diameters fixed on the sub shaft, the relay gear of smaller diameter being in engagement with the driving gear and the relay gear of larger diameter being in engagement with the driven gear, whereby the blanket cylinders of the four cylinder train unit are moved between a first position and a second position by a single stroke of the actuator, the first position being that in which the blanket cylinders make contact with each other and with their respective plate cylinders and are isolated from their respective impression cylinders of the three cylinder train units, the second position being that in which the blanket cylinders are isolated from each other and make contact with their respective plate cylinders and with their respective impression cylinders of the three cylinder train units, first throw-off means for bodily moving each of the blanket cylinders of the four cylinder train unit through a short radius arc from the first position to a first intermediate position defined within the range of which teeth of a gear train for driving the four cylinder train unit at the first position are not out of gearing, said first intermediate position being that in which the blanket cylinders are isolated from each other, from their associated plate cylinders and from their associated impression cylinders, and a second throw-off means for bodily moving each of the blanket cylinders of the four cylinder train unit through a short radius arc from the second position to a second intermediate position defined within the range of which teeth of a pair of gear trains for each driving the pair of three cylinder train units at the second position are not out of gearing, the second intermediate position being that in which the blanket cylinders are isolated from each other, from their associated plate cylinders and from their associated impression cylinders.

3. A multiple-purpose offset rotary printing press comprising:

a pair of three cylinder train units juxtaposed in symmetrical arrangement and each consisting of a plate cylinder, and an impression cylinder with a blanket cylinder being between and contacting with both of them, a four cylinder train unit consisting of a pair of blanket cylinders contacting with each other at a position adjacent to both of the impression cylinders of the three cylinder train units and a pair of plate cylinders contacting with the pair of blanket cylinders for cooperating therewith respectively, and switching means for bodily moving each of the blanket cylinders of the four cylinder train unit through a short radius arc, comprising eccentric sleeves journalling the both axial ends of the blanket cylinders of the four cylinder train unit, a common operative link mechanism connected to the sleeves for rocking them simultaneously, an actuator, an angle increase shifting mechanism provided between said link mechanism and the actuator, said angle increase shifting mechanism comprising a main shaft and a sub shaft, both shafts being mounted on a frame, a driving gear rotatably mounted on the main shaft and adapted to follow the displacement of the actuator, a driven gear fixed on the main shaft and adapted to transmit a displacement to the link mechanism, a pair of relay gears having different diameters fixed on the sub shaft, the relay gear of smaller diameter being in engagement with the driving gear and the relay gear of larger diameter being in engagement with the driven gear, whereby the blanket cylinders of the four cylinder train unit are moved between a first position and a second position by a single stroke of the actuator, the first position being that in which the blanket cylinders make contact with each other and with their respective plate cylinders and are isolated from their respective impression cylinders of the three cylinder train units, the second position being that in which the blanket cylinders are isolated from each other and make contact with their respective plate cylinders and with their respective impression cylinders of the three cylinder train units, a pin clutch mechanism comprising a driven disc disposed between the driven gear and the link, coaxially with the driven gear and connected to an end of the link, each of the driven gear and the driven disc having a clutch pin insertion bore for receiving a clutch pin for connecting the driven gear and the driven disc unitarily with each other, the driving gear having two clutch pin insertion bores formed at two portions thereof aligning with the clutch pin insertion bore of the driven disc when the blanket cylinders of the four cylinder train unit are at the first and second positions, and a clutch pin actuating mechanism adapted to longitudinally shift a clutch pin between two kinds of engagement and disengagement, one engagement being between the driven disc and the driven gear and the other engagement being between the driven disc and the driving gear, first throw-off means for bodily moving each of the blanket cylinders of the four cylinder train unit through a short radius arc from the first position to a first intermediate position defined within the range of which teeth of a gear train for driving the four cylinder train units at the first position are not out of gearing, said first intermediate position being that in which the blanket cylinders are isolated from each other, from their associated plate cylinders and from their associated impression cylinders, and a second throw-off means for bodily moving each of the blanket cylinders of the four cylinder train unit through a short radius arc from the second position to a second intermediate position defined within the range of which teeth of a pair of gear trains for each driving the pair of three cylinder train units at the second position are not out of gearing, the second intermediate position being that in which the blanket cylinders are isolated from each other, from their associated plate cylinders and from their associated impression cylinders.

4. A multiple-purpose offset rotary printing press comprising:

a pair of three cylinder train units juxtaposed in symmetrical arrangement and each consisting of a plate cylinder, and an impression cylinder with a blanket cylinder being between and contacting with both of them, a four cylinder train unit consisting of a pair of blanket cylinders contacting with each other at a position adjacent to both of the impression cylinders of the three cylinder train units and a pair of plate cylinders contacting with the pair of blanket cylinders for cooperating therewith respectively, and switching means for bodily moving each of the blanket cylinders of the four cylinder train unit through a short radius arc, comprising eccentric sleeves journalling the both axial ends of the blanket cylinders of the four cylinder train unit, a common operative link mechanism connected to the sleeves for rocking them simultaneously, an actuator, an angle increase shifting mechanism provided between said link mechanism and the actuator, said angle increase shifting mechanism comprising a main shaft and a sub shaft, both shafts mounted on a frame, a driving gear rotatably mounted on the main shaft and adapted to follow the displacement of the actuator, a driven gear fixed on the main shaft and adapted to transmit a displacement to the link mechanism, a pair of relay gears having different diameters fixed on the sub shaft, the relay gear of smaller diameter being in engagement with the driving gear and the relay gear of larger diameter being in engagement with the driven gear to provide a gear increase ratio of 1:3 whereby the blanket cylinders of the four cylinder train unit are moved between a first position and a second position by a single stroke of the actuator, the first position being that in which the blanket cylinders make contact with each other and with their respective plate cylinders and are isolated from their respective impression cylinders of the three cylinder train units, the second position being that in which the blanket cylinders are isolated from each other and make contact with their respective plate cylinders and with their respective impression cylinders of the three cylinder train units, a pin clutch mechanism comprising a driven disc disposed between the driven gear and the link, coaxially with the driven gear and connected to an end of the link, each of the driven gear and the driven disc having a clutch pin insertion bore for receiving a clutch pin for connecting the driven gear and the driven disc unitarily with each other, the driving gear having two clutch pin insertion bores formed at two portions thereof aligning with the clutch pin insertion bore of the driven disc when the blanket cylinders of the four cylinder train unit are at the first and second positions, and a clutch pin actuating mechanism adapted to longitudinally shift a clutch pin between two kinds of engagement and disengagement, one engagement being between the driven disc and the driven gear and the other engagement being between the driven disc and the driving gear, first throw-off means for bodily moving each of the blanket cylinders of the four cylinder train unit through a short radius arc from the first position to a first intermediate position defined within the range of which teeth of a gear train for driving the four cylinder train units at the first position are not out of gearing, said first intermediate position being that in which the blanket cylinders are isolated from each other, from their associated plate cylinders and from their associated impression cylinders, and a second throw-off means for bodily moving each of the blanket cylinders of the four cylinder train unit through a short radius arc from the second position to a second intermediate position defined within the range of which teeth of a pair of gear trains for each driving the pair of three cylinder train units at the second position are not out of gearing, the second intermediate position being that in which the blanket cylinders are isolated from each other, from their associated plate cylinders and from their associated impression cylinders.

* * * * *